United States Patent [19]

Noe

[11] 4,066,053

[45] Jan. 3, 1978

[54] ELECTRONIC IGNITION SYSTEM

[75] Inventor: John B. Noe, Norman, Okla.

[73] Assignee: Plasmatronics Company, Norman, Okla.

[21] Appl. No.: 741,542

[22] Filed: Nov. 15, 1976

Related U.S. Application Data

[63] Continuation-in-part of Ser. No. 605,533, Aug. 18, 1975, Pat. No. 4,005,694.

[51] Int. Cl.[2] ..... F02P 1/00

[52] U.S. Cl. ..... 123/148 CA; 123/148 CB; 315/209 CD

[58] Field of Search ..... 315/209 CD; 123/148 E, 123/148 CB, 148 CA

[56] References Cited

U.S. PATENT DOCUMENTS

| | | | |
|---|---|---|---|
| 3,334,619 | 8/1967 | Penn | 123/148 CA |
| 3,531,738 | 9/1970 | Thakore | 123/148 CA |
| 3,882,839 | 5/1975 | Ganoung | 123/148 CA |
| 4,005,694 | 2/1977 | Noe | 123/148 CA |

*Primary Examiner*—Ronald B. Cox
*Attorney, Agent, or Firm*—Robert M. Hessin

[57] ABSTRACT

An internal combustion engine ignition device of the capacitive discharge type which utilizes a single transistor, semi-conductive controlled rectifier and attendant reactive circuitry to provide timed high voltage application to create a direct current arc, or plasma, at the spark discharge devices. The circuit is actuated by closure of the contact points to energize a transistor to operate in a Class D amplifier mode that, in turn, enables conduction through the primary of a transformer, the secondary of which places increased voltage charge on a capacitor to a predetermined charge level. Thereafter, opening of the contact points causes conduction of the semi-conductive controlled rectifier which allows discharge of the charged capacitor through a current steering bridge to the ignition coil to enable application of high voltage for establishing a direct current arc, or plasma, at the spark discharge device.

11 Claims, 1 Drawing Figure

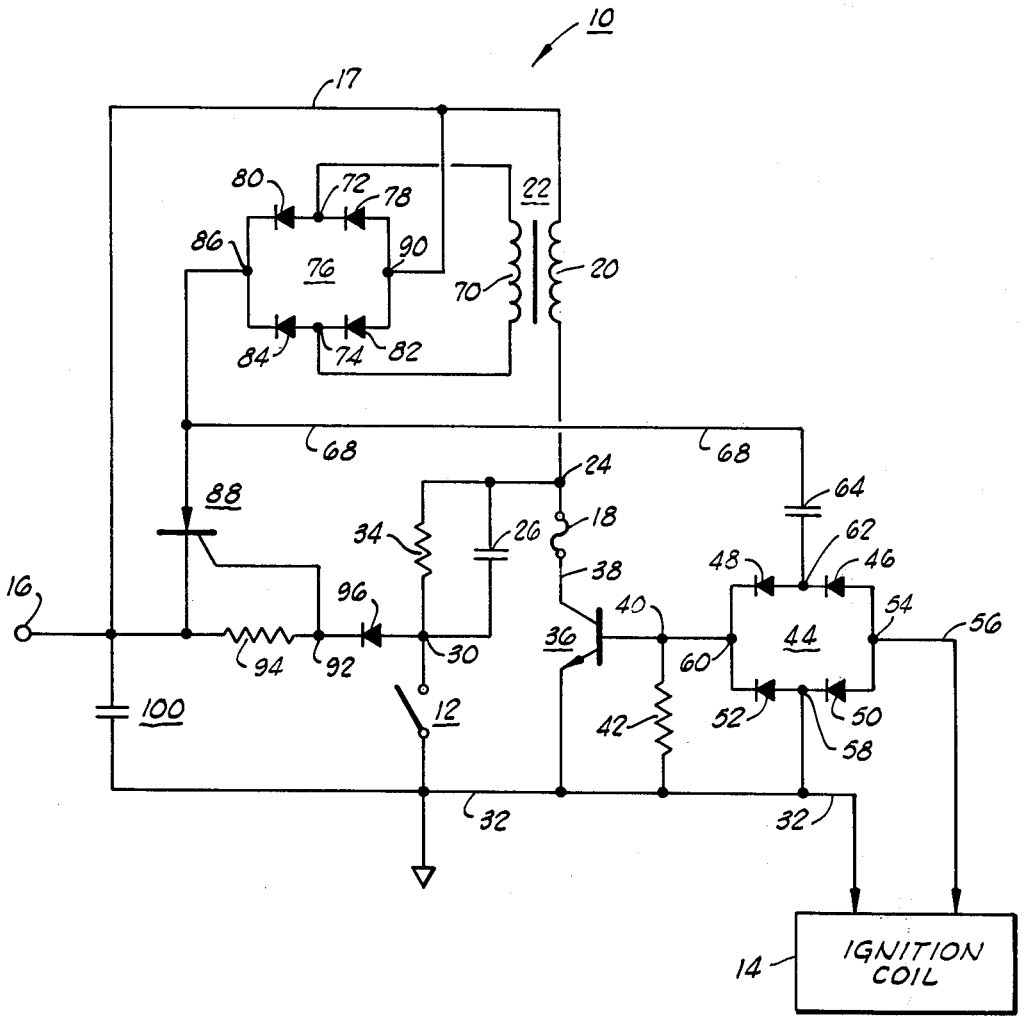
10
17
80
72
78
22
86
76
90
20
70
84
74
82
68
68
24
88
64
34
26
18
62
48
46
38
16
96
40
54
56
94
92
30
36
44
60
100
12
42
52
50
58
32
32
14
IGNITION COIL

ELECTRONIC IGNITION SYSTEM

REFERENCE TO RELATED APPLICATION

The present invention is a continuation-in-part of copending application Ser. No. 605,533, now U.S. Pat. No. 4,005,694 filed on Aug. 18, 1975 and entitled "Electronic Ignition System".

BACKGROUND OF THE INVENTION

1. Field of the Invention

The invention relates generally to electronic ignition systems, and more particularly, but not by way of limitation, it relates to an improved form of capacitive discharge ignition circuit for use with internal combustion engines.

2. Description of the Prior Art

The prior art includes numerous forms of circuitry for use as electronic ignition systems, many of which are capacitive discharge types of system. The general form that such circuitry has taken in the past has included various types of electronic stages as utilized in what may be generally classified as a D-C to D-C converter, a timed chopping network or electronic switch responsive to a trigger generated by the associated distributive timing device, and a high voltage coil or autotransformer for energizing respective spark devices in timed relationship. There is no prior art known to the Inventor which functions in similar manner or with like form of circuitry as the present invention.

SUMMARY OF THE INVENTION

The present invention contemplates an electronic ignition system for use with internal combustion engines of a type where high voltage charging of a discharge capacitor is carried out during a period of contact point closure, and upon opening of the contact points an SCR is energized to enable conduction or discharge of the high voltage capacitor through a current steering bridge circuit which functions not only to apply high voltage energization to the ignition coil but also to assure proper conduction cessation of the semi-conductive controlled rectifier.

Therefore, it is an object of the present invention to provide a capacitive discharge system which is not only of generally lower cost and more simple construction, but also of greater reliability in operation.

It is also an object of the invention to provide a circuit for timed spark plug energization which has very rapid voltage rise time and more than sufficient duration thereby to enable more efficient fuel utilization and to extend further the operative lifetime of spark plugs.

It is yet another object of the present invention to provide a capacitive discharge ignition circuit which greatly improves overall internal combustion engine performance and will greatly conserve fuel consumption while yet increasing engine operation to a more acceptable level.

Finally, it is an object of the present invention to provide an improved electronic ignition circuit for automotive engines which assures totality of fuel consumption and, therefore, increased engine efficiency such that a lesser volume of harmful emittants are produced for exhaust into the environment.

Other objects and advantages of the invention will be evident from the following detailed description when read in conjunction with the accompanying drawing which illustrates the invention.

BRIEF DESCRIPTION OF THE DRAWING

The drawing illustrates the circuit of the present invention in schematic representation.

DETAILED DESCRIPTION OF THE PREFERRED EMBODIMENT

An ignition circuit 10 functions in response to a distributor point switch 12 to provide periodic high voltage input to an ignition coil 14 which, in well-known manner, energizes the engine spark plugs in properly timed relationship. The ignition coil 14 and contact points 12 may take the form of the conventional form of rotor distributor element as generally utilized with internal combustion engines, but it should be kept in mind that the ignition circuit 10 is adaptable for usage with any of the various alternatives such as magnetic distributor elements, optical triggering elements and other more recently developed engine timing devices.

Positive D-C supply voltage is supplied at a terminal 16 through a conventional protective fuse 18 to the primary 20 of a high voltage transformer 22. The primary 20 is then connected to a junction point 24 which extends a parallelconnected capacitor 26 and resistor 34 to a junction point 30 and point switch 12. The remaining side of point switch 12 is then connected directly to the system ground 32. A high wattage, small resistance resistor 34 is connected between junction point 24 and junction point 30 adjacent point switch 12 in order to provide continual small current flow in order to burn away any oil residue or oxides that may be present at the contacts of point switch 12.

An NPN transistor 36 is then connected common-emitter with collector 38 connected to junction point 24 and the primary 20 of the transformer 22, while the transistor base is connected to a junction point 40 and grounded protective resistor 42 as well as steering bridge network 44. The steering bridge 44 consists of rectifier 46, 48, 50 and 52 in conventional bridge array with output bridge junction 54 connected to an input lead 56 to ignition coil 14. A bridge junction 58 is then connected directly to ground buss 32 which is also applied to ignition coil 14, and a positive bridge junction 60 is connected to junction point 40 and the base of transistor 36 while the remaining bridge junction 62 is connected to a high voltage capacitor 64 in series with a lead 68.

Referring again to transformer 22, a step-up transformer of selected windings ratio as will be further described, a secondary winding 70 is connected to opposed input bridge junctions 72 and 74 of a high voltage bridge rectifier 76 consisting of individual rectifiers 78, 80, 82 and 84. An output bridge junction 86 is then connected to lead 68 as well as to the anode of a semiconductive controlled rectifier 88. The remaining bridge junction 90 of bridge rectifier 76 is then connected to a junction point 16. The cathode electrode of semi-conductive controlled rectifier (SCR) 88 is connected directly to junction point 16. Resistor 94 is then connected between the cathode and the SCR gate electrode or junction point 92, while a rectifier 96 is connected between junction point 92 and junction point 30 at contact point switch 12.

In operation, with capacitor 26 discharged, closure of contact point switch 12 will cause current flow through primary 20 of transformer 22 to induce a large voltage pulse in secondary 70 as applied to bridge rectifier 76. The bridge junction 86 is then connected via lead 68 to a high voltage capacitor 64, on the order of one to two microfarads, which in turn is tied to current steering bridge 44. The collector of transistor 36 is also connected via lead 38 to junction point 24 and transformer primary 20 while the emitter is connected to ground 32, and the base of the transistor is connected to the positive junction point 60 of current steering bridge 44 such that the large voltage pulse from the secondary of transformer 22 will cause transistor 36 to conduct during its voltage output duration.

Thus, there is a regenerative process, transistor 36 will continue to conduct until the capacitor 64 is fully charged, i.e., up to 300 volts or more, depending upon the transformer turns ratio, at which time current flow will stop and transistor 36 will turn off. A low resistance resistor 42 is connected from base junction 40 to ground 32 in order to assure complete turnoff. Less than 0.5 volts will exist across the transistor 36 at the start of the charge cycle, and the voltage will decay to essentially zero at the end of the charge cycle. As a result, the efficiency of the circuit is extremely high.

The time required to charge a two microfarad capacitor is on the order of one millisecond, and if the contact point switch 12 should open before the capacitor charge cycle is completed, the voltage differential across point switch 12 will be too low to turn on SCR 88 at any time when transistor 36 is conducting, i.e., during the capacitor charge cycle. This action tends to eliminate point bounce effects upon the circuit.

A rectifier 96 and resistor 94 function to assure complete turnoff of SCR 88 after the requisite conduction thereof. The SCR can only be fired when adequate energy is stored in the transformer primary by current flow through resistor 34 and point switch 12. Capacitor 26, which is connected in parallel with resistor 34, assures high speed operation of the circuit. When the contact point switch 12 is open, the stored current flows through rectifier 96 to the gate electrode of SCR 88 thereby to cause conduction of the SCR 88. Conduction of SCR 88 via lead 68 allows discharge of high voltage capacitor 64 through current steering bridge 44 to energize ignition coil 14. The voltage across capacitor 64 decays sinusoidally as the energy is transferred to the ignition coil 14 primary, as clamped to ground by current steering bridge 44, and the current in the ignition coil 14 will reach a maximum when the voltage at capacitor 64 reaches zero. The SCR 88 will cease to conduct at this time. Thus, current continues to flow and sustain the spark plug arc or plasma until all energy is dissipated.

The time interval from opening of point switch 12 to spark formation will depend upon the design of the ignition coil 14 and will generally be in the duration of 0.5 to 10 microseconds, while the spark duration will be on the order of three hundred to five hundred microseconds. Such fast rise time serves to assure firing of fouled spark plugs since the gap potential reaches the arc point faster than shunting deposits can drain away energy. This also has the effect of making the system virtually waterproof. The overall effects of fast rise time and the direct current arc serve further to benefit any form of radio frequency reception or transmission in or about the user vehicle as only a small amount of electromagnetic energy is radiated in initiating a single spark of one polarity. The capacitor 100 may be several thousand microfarads since it must supply the energy to charge capacitor 64 in the event of failure or absence of the battery.

The foregoing discloses a novel capacitive discharge ignition system which includes attributes of fast rise time, long spark duration and efficient use of source energy. Longterm reliable operation of the system is assured by the low electrical stress levels placed on the electronic components, individually and collectively, making possible a virtually maintenance-free ignition system.

The ignition circuit is capable of supplying adequate energy to any internal combustion engine of the types generally utilizing such ignition systems without deterioration of this capability over extended periods of time, and the circuit has the capability of assuring complete combustion of the fuel to aid not only in conservation of fuel but also in lessening the amount of harmful exhaust emittants. The present invention achieves the desirable attributes as to fuel conservation and low pollution contribution even though the overall design is directed to electronic simplicity and efficiency of operation.

Changes may be made in the combination and arrangement of elements as heretofore set forth in the specification and shown in the drawings; it being understood that changes may be made in the embodiment disclosed without departing from the spirit and scope of the invention as defined in the following claims.

What is claimed is:

1. An electronic ignition circuit for use in combination with an internal combustion engine having an electrical power source and ignition means for energization of at least one spark discharge device, comprising:

a capacitor;

switch means actuatable between open and closed positions;

means including a transformer connected to said power source and energized by said switch in the closed position to charge said capacitor to an increased voltage value;

controlled rectifier means having the cathode connected to said power source and the anode connected to said capacitor, which controlled rectifier means is energized by opening said switch means to effect discharge of said capacitor; and bridge rectifier means connected to conduct current from discharge of said capacitor to said ignition means while clamping the instantaneous voltage value relative to ground.

2. An electronic ignition circuit as set forth in claim 1 wherein said means including a transformer further comprises:

transistor means connected common-emitter in parallel with said switch means with the base connected to said bridge rectifier means, said transistor means being conductive while said switch is in the closed position.

3. An electronic ignition circuit as set forth in claim 1 wherein said means including a transformer further comprises:

a second bridge rectifier receiving increased voltage output from said transformer when energized and providing D-C voltage output to charge said capacitor.

4. An electronic ignition circuit as set forth in claim 2 wherein said means including a transformer further comprises:

a second bridge rectifier receiving increased voltage output from said transformer when energized and providing D-C voltage output to charge said capacitor.

5. An electronic ignition circuit as set forth in claim 1 which is further characterized to include:

rectifier means connected between said switch means and the gate electrode of the controlled rectifier means; and a resistance connected between said gate electrode and said power source.

6. An electronic ignition circuit as set forth in claim 2 which is further characterized to include:

a capacitor connected between said switch means and the collector of said transistor means.

7. An electronic ignition circuit for use in combination with an internal combustion engine having an electrical power source and ignition means for energization of a spark discharge device, comprising:

a capacitor having first and second terminals;

transformer means having a primary and secondary winding with the primary winding connected to said power source;

rectifier means connecting said secondary winding to the first terminal of said capacitor;

bridge means having opposing input junctions connected between the capacitor second terminal and ground, and having first and second output junctions with the second output junction connected to said ignition means;

transistor means connected common-emitter to said primary winding with the base connected to said bridge means first output junction;

switch means connected between ground and said primary winding and closable to energize the transformer means and charge the capacitor while rendering the transistor means conductive for the charging duration; and controlled rectifier means having the anode connected to said capacitor first terminal and the cathode connected to said power source which is rendered conductive upon opening said switch means to discharge said capacitor through the bridge means thereby to energize said ignition means.

8. An electronic ignition circuit as set forth in claim 7 wherein said rectifier means is a full wave bridge rectifier.

9. An electronic ignition circuit as set forth in claim 8 which is further characterized to include:

a second capacitor connected in series between said transformer means primary winding and said switch means to initiate conduction of said transistor means upon closure of said switch means.

10. An electronic ignition circuit as set forth in claim 7 which is further characterized to include:

a second rectifier means connected between said switch means and the gate electrode of said controlled rectifier means to render the controlled rectifier means conductive upon opening of the switch means.

11. An electronic ignition circuit as set forth in claim 10 which is further characterized to include:

a resistance connected between said power source and the gate electrode of said controlled rectifier means.

* * * * *